United States Patent [19]

Miyagawa et al.

[11] 4,231,564

[45] Nov. 4, 1980

[54] PAPER SHEET HOLDING DEVICE FOR PAPER SHEET COUNTER

[75] Inventors: Tuyoshi Miyagawa; Junichi Arikawa, both of Tokyo, Japan

[73] Assignee: Laurel Bank Machine Co., Ltd., Tokyo, Japan

[21] Appl. No.: 18,273

[22] Filed: Mar. 7, 1979

[30] Foreign Application Priority Data

Mar. 15, 1978 [JP] Japan ..... 53-33009

[51] Int. Cl.[3] ..... B65H 1/02; B65H 1/26

[52] U.S. Cl. ..... 271/95; 271/171

[58] Field of Search ..... 271/95, 162, 171, 30 A, 271/129, 149, 150, 8 A, 220, 223, 224, 213; 248/354 R

[56] References Cited

U.S. PATENT DOCUMENTS

| | | | |
|---|---|---|---|
| 1,982,823 | 7/1932 | Meredith | 271/150 |
| 3,658,323 | 4/1972 | Matwey | 271/223 |
| 3,953,022 | 4/1976 | Oshima | 271/95 |

*Primary Examiner*—Robert B. Reeves
*Assistant Examiner*—Brian Bond
*Attorney, Agent, or Firm*—Fleit & Jacobson

[57] ABSTRACT

A paper sheet holding device for holding and bringing paper sheets to a paper sheet counter of suction type. The holding device includes two base plates, one of which is stationary whereas the other is rotatable and both of which are used to bear thereon the paper sheets in an upright position. Further inclusive are an upright holder plate, which is carried in an upright position on the rotatable base plate for holding the back of the paper stack, and a holder arm which is made coactive with the holder plate for holding the paper sheets. A pair of telescopic pipe rods are telescopically received in the holder plate and in the holder arm so that they may be pulled out to and retained at a preset height. Thus, the pipe rods can be extended to prevent the paper sheets from being hung even if the paper sheets are too wide for the height or heights of the holder plate and arm as they are.

9 Claims, 5 Drawing Figures

PAPER SHEET HOLDING DEVICE FOR PAPER SHEET COUNTER

BACKGROUND OF THE INVENTION

1. Field of the Invention

The present invention relates to a paper sheet counter for automatically counting paper sheets such as paper currency or bonds, and more particularly to a paper sheet holding device for use with the paper sheet counter so as to hold the paper sheets in position for the purpose of counting.

2. Description of the Prior Art

In a paper sheet counter of known type, a bundle of paper sheets is held in an upright position upon a paper sheet holding device, and this holding device is turned so that one leading side of the paper sheet bundle is brought close to a plurality of suction heads which are mounted on a rotary suction cylinder. Thus, the paper sheets are sucked by the suction of the suction heads so that they may be deflected one by one for the purpose of counting.

In the holding devices of the prior art counters, however, both the holder plate for holding and rocking the paper sheets back and forth and the holder arm for holding the paper sheets in cooperation with the holder plate are standardized in size, namely, they are as high as the width of the paper sheets. In case, therefore, wider paper sheets are to be counted, their upper portions fail to be held between the holder plate and arm of the holding device so that the projecting edges hang loosely over the upper end of the holder plate. This leads to the disadvantage that the count is frequently inaccurate.

SUMMARY OF THE INVENTION

It is therefore an object of the present invention to provide a paper sheet holding device for use with a paper sheet counter which is free from the drawback of the prior art.

Another but major object of the present invention is to provide a paper sheet holding device of the above type, in which there is mounted on each of the holder plate and the arm an upright keep rod equipped with a receptacle and with a telescopic pipe rod to be received telescopically in the receptacle so that, for the purpose of counting wider paper sheets, the telescopic pipe rods can be pulled out of their receptacles so as to hold the upper portions of the paper sheets in their upright position while preventing those upper portions from hanging downward and ensuring the desired accurate counting of the paper sheets.

According to a major feature of the present invention, there is provided a paper sheet holding device for holding and bringing paper sheets to a paper sheet counter including a rotary suction cylinder communicated with a vacuum source, and a plurality of suction heads carried on said rotary suction cylinder and made rotatable for sucking the paper sheets one by one so that the sheets can be deflected and counted when the same are brought close to said suction cylinder, said paper sheet holding device comprising: a stationary base plate for bearing thereon one end portion of the lower longer side of an upright stack of the paper sheets; a rotatable base plate for carrying thereon the other end portion of the lower longer side of the upright paper stack; an upright holder plate carried in an upright position on the trailing side of said rotatable base plate and having its extending end positioned just above said stationary base plate for holding the back of the paper stack; a first upright keep rod mounted on the outer wall of said holder plate; a holder arm extending close to said paper sheet counter and made coactive with said holder plate for holding the paper sheets; a second upright keep rod mounted on said holder arm; a receptacle formed in each of the first-and second-named keep rods; and a telescopic pipe rod received telescopically in each of the receptacles so that it may be pulled out to and retained at a preset height, whereby the two telescopic pipe rods can be extended to prevent the paper sheets from hanging downward even if the latter are too wide for the heights of said holder plate and said holder arm as they are.

BRIEF DESCRIPTION OF THE DRAWINGS

Other objects and advantages of the present invention will become apparent from the following description made with reference to the accompanying drawings, in which:

FIG. 4 is a perspective view showing the essential portions of the paper sheet counter with the telescopic pipe rods being pulled in.

DESCRIPTION OF THE PREFERRED EMBODIMENT

Figure 1:
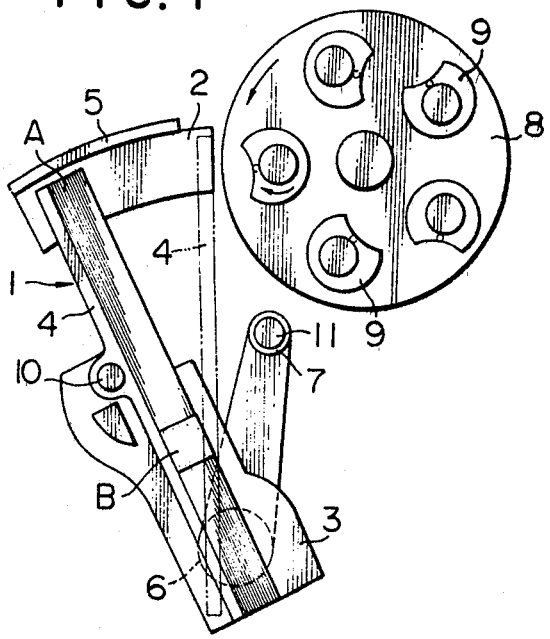
FIG. 1 is a diagrammatic top plan view showing the essential portions of the paper sheet counter with which the paper sheet holding device according to the present invention is to be used.

The present invention will now be described in connection with the preferred embodiment thereof with reference to the accompanying drawings. Referring first to FIG. 1, there is shown a holder 1 which is used with a paper sheet counter so as to hold sheets of paper A in position. The paper sheet holder 1 includes: a stationary base plate 2 for bearing thereon one end portion of the lower longer side of an upright stack of the paper sheets A; a rotatable base plate 3 for carrying thereon the other end portion of the lower longer side of the upright paper stack A; an upright holder plate 4 carried in an upright position on the trailing side of the rotatable base plate 3 and having its extending end positioned just above the stationary base plate 2 for holding the back of the paper stack A; a curved guide plate 5 mounted in an upright position upon the radial extremity of the stationary base plate 2 for guiding the extending ends of the paper sheets A in a sliding contact manner when the latter are carried by the rotatable base plate 3; a drive shaft 6 mounted on the lower side of the rotatable base plate 3 for turning the same; and a holder arm 7 made coactive with the holder plate 4 for holding the paper sheets A when the latter are to be counted. At the leading side of the paper sheet holder 1, there is arranged a counting device of suction type which is made coactive with the paper sheet holder 1 for counting the paper sheets A. The suction type counting device includes a rotary suction cylinder 8 in communication with a vacuum source, and a plurality of suction heads 9 carried in a circle on the upper side of the rotary suction cylinder 8 and made rotatable for sucking the paper sheets A one by one so as to deflect and count or individualize the same while rotating their respective axes and revolving about the axis of the suction cylinder 8 each time the paper sheets A are carried periodically by the paper sheet holder 1 to come close to the counting device.

The height or heights of the holder plate 4 and the holder arm 7 of the paper sheet holder 1 are predetermined to be on a level with the width of paper currency to be counted. One upright keep rod 10 is mounted on the outer wall of the holder plate 4 whereas the other upright keep rod 11 is mounted on the holder arm 7. Each of the keep rods 10 and 11 is constructed of a receptacle 12 and a telescopic pipe rod 13 which is received in the receptacle 12. This receptacle 12 is composed of a cylindrical receptacle body 12*a* having its upper end opened, and a threaded portion 12*b* formed at the lower extremity of the receptacle body 12*a*. On the other hand, the telescopic pipe rod 13 is composed of a plurality of pipe rod elements 14 having their diameters reduced stepwise so that they may be fitted snugly one in another. A pull head 15 is formed on the upper extremity of the uppermost pipe rod element 14 which has the smallest diameter. The lengths of the pipe rod elements 14 are made smaller as the diameters of the same become the smaller. Moreover, each of the pipe rod elements 14 is formed at its lower extremity with a lower expanded portion 14*a* so that it may be retained thereat while being prevented from being slipped out of an adjacent element having a larger diameter. On the other hand, each pipe rod element 14 is formed at its upper extremity with an upper reduced portion 14*b* so that it may retain thereat while preventing an adjacent element having a smaller diameter from slipping therefrom. The respective expanded and reduced portions 14*a* and 14*b* are so sized as to be brought into suitable frictional contact with the inner and outer walls of the pipe rod elements 14, respectively, so that the telescopic pipe rod 13 can always be pulled out to and retained at a desired height.

Indicated at character B is a paper band which is used to bundle the paper sheets A while the latter are stacked before the counting operation.

Figure 2:
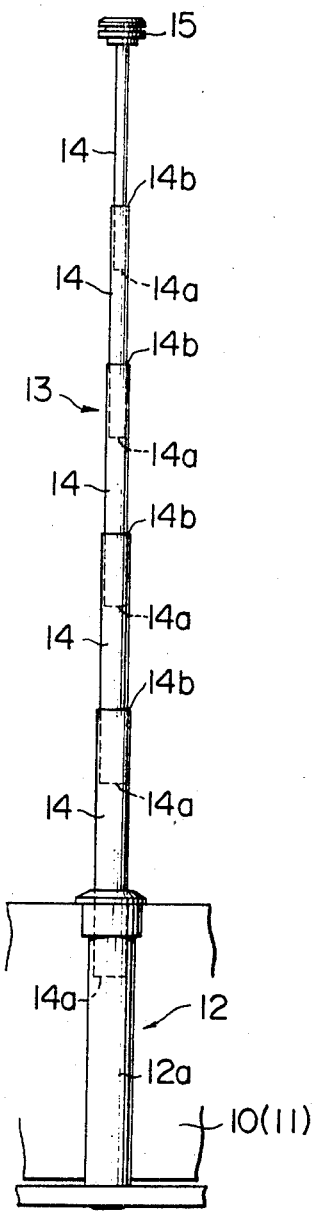
FIG. 2 is a side elevation showing the telescopic pipe rod of one of upright keep rods in its pulled out condition.
Figure 5:
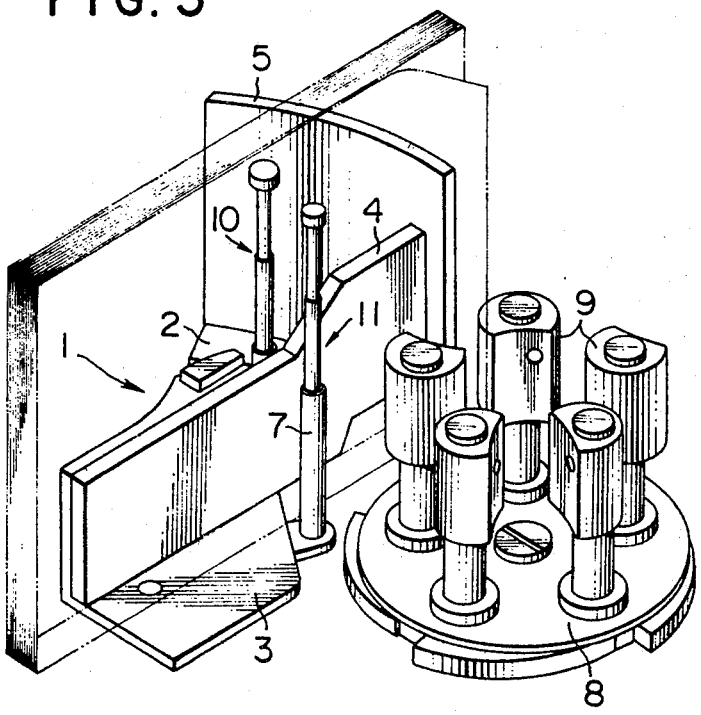
FIG. 5 is a perspective view showing the essential portions of the paper sheet counter with the telescopic rods being pulled out.

Now, description will proceed to the operations of the paper sheet holding device thus constructed according to the present invention. First of all, in case a bundle of paper sheets A wider than paper currency are to be counted, the paper sheet holder 1 is prepared in advance to take the position, as shown in FIG. 1 and FIG. 5, and the pull heads 15 of the keep rods 10 and 11 of the holder plate and arm 4 and 7 are pulled until the telescopic pipe rods 13 are extracted out of their receptacles 12 to reach such a height as is substantially on a level with the width of the paper sheets A, as best seen from FIG. 2.

Next, if the paper sheets A are placed upon their holder 1, then the holder plate 4 is carried clockwise by means of a drive mechanism (not shown) so that the paper sheets A are brought close to one of the suction heads 9 of the suction cylinder 8 until they are held between the holder plate and arm 4 and 7. At this time, the upper portions of the paper sheets A are held by the pipe rods 13 extended from the keep rods 10 and 11 of the holder plate and arm 4 and 7 so that they can be prevented from hanging over the plate and arm 4 and 7. When, in this way, the paper sheets A are brought by their holder 1 to cover the suction port (not shown) of the closest suction head 9, a vacuum pump (not shown) starts its operation. When the vacuum to be established by the vacuum pump reaches a preset level, the suction cylinder 8 is turned by a drive mechanism (not shown) in the counter-clockwise direction, as viewed from FIG. 1, and at the same time that particular suction head 9 is turned clockwise while being carried about the axis of the suction cylinder 8 so that one of the paper sheets A is deflected and individualized by the suction.

Figure 3:
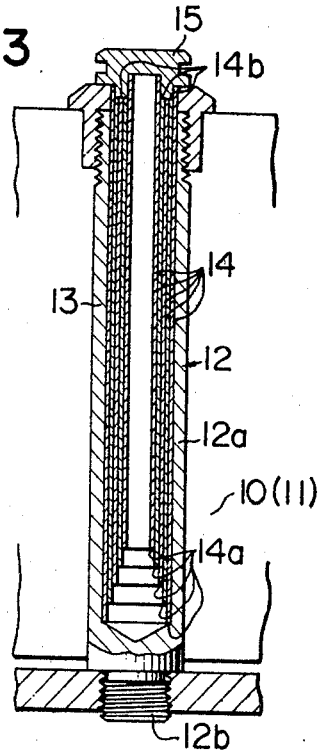
FIG. 3 is a side elevation showing a longitudinal section of the pipe rod in its retracted condition.
Figure 4:
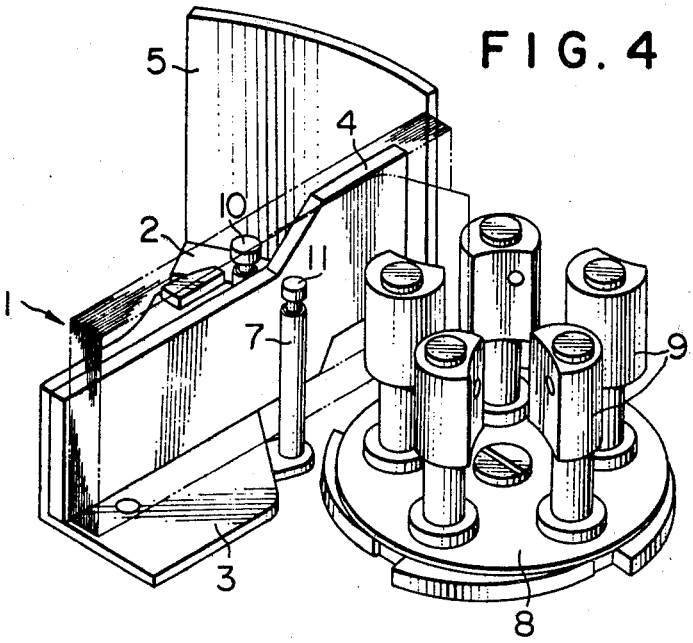

On the contrary, in case sheets of paper currency or paper sheets narrower than paper currency are to be counted, the pull heads 15 are depressed into the keep rods 10 and 11 of the holder plate and arm 4 and 7 until the pipe rods 13 are received in their respective receptacles 12, as best seen from FIG. 3 and FIG. 4, thus preparing for the counting of the paper sheets.

As has been described hereinbefore, according to the present invention, there is mounted on each of the holder plate and arm of the paper sheet holder an upright keep rod which is made to carry the receptacle and the telescopic pipe rod received in the receptacle. As a result, in case it is intended to count wider paper sheets, the pipe rods are pulled out of their receptacles to hold the upper portions of the paper sheets so that those portions can be prevented without fail from hanging downward. Thus, it is possible to accurately count paper sheets of larger size. On the contrary, in case it is intended to individualize for counting narrower paper sheets, the telescopic pipe rods can be accommodated in their receptacles. As a result, the pipe rods are not likely to offer any obstacle to the counting operations. Moreover, the keep rods themselves can be mounted compactly on the paper sheet holder. Since, moreover, the pipe rods are mounted undetachably upon the holder, they cannot be lost but can be adjusted freely to a desired length whenever the width of the paper sheets to be counted changes.

What is claimed is:

1. In a paper sheet counter including a rotary suction cylinder in communication with a vacuum source, and a plurality of suction heads carried on said rotary suction cylinder and made rotatable for sucking paper sheets one by one so as to deflect and individualize for counting the same when the same are brought close to said suction cylinder, a paper sheet holding device for holding and bringing the paper sheets to said paper sheet counter, comprising:

a stationary base plate for bearing thereon one end portion of the lower longer side of an upright stack of the paper sheets;

a rotatable base plate for carrying thereon the other end portion of the lower longer side of the upright paper stack;

an upright holder plate carried in an upright position on the trailing side of said rotatable base plate and having its extending end positioned just above said stationary base plate for holding the back of the paper stack;

a first upright keep rod mounted on the outer wall of said holder plate;

a holder arm extending close to said paper sheet counter and made coactive with said holder plate for holding the paper sheets;

a second upright keep rod mounted on said holder arm;

a receptable formed in each of the first- and second-named keep rods; and a telescopic pipe rod received telescopically in each of the receptacles so that it may be pulled out to and retained at a preset height, whereby the two telescopic pipe rods can be vertically extended to be capable of holding the paper sheets between the two telescopic pipe rods and thereby preventing the paper sheets from hanging downward even if the latter are too wide for the heights of said holder plate and said holder arm as they are.

2. A paper sheet holding device according to claim 1, wherein each of said receptacles includes a cylindrical body having its upper end opened, and threaded portion formed at the lower extremity of said cylindrical body for fixing each of said receptacles in position upon each of said keep rods.

3. A paper sheet holding device according to claim 1, wherein each of said telescopic pipe rods includes a plurality of pipe rod elements having their diameters reduced stepwise so that they may be fitted snugly one in another.

4. A paper sheet holding device according to claim 3, wherein the uppermost pipe rod element having the smallest diameter has its upper extremity formed with a pull head which can be pulled to extend each of said telescopic pipe rods.

5. A paper sheet holding device according to claim 3, wherein said pipe rod elements are made the shorter as their diameters become the smaller.

6. A paper sheet holding device according to claim 3, wherein each of said pipe rod elements has its lower extremity formed with a lower expanded portion so that it may be retained thereat while being prevented from being slipped out of its adjacent rod pipe element having a larger diameter.

7. A paper sheet holding device according to claim 3, wherein each of said pipe rod elements has its upper exremity formed with an upper reduced portion so that it may be retain thereat while preventing its adjacent pipe rod element of a smaller diameter from slipping therefrom.

8. A paper sheet holding device according to claim 1, further comprising a curved guide plate mounted in an upright position upon the radial extremity of said stationary base plate for guiding the extending ends of the paper sheets in a sliding contact manner when the latter are carried by said rotatable base plate.

9. A paper sheet holding device according to claim 1, further comprising a drive shaft mounted to the lower side of said rotatable base plate for turning the same thereabout.

* * * * *